United States Patent [19]

Ueda

[11] 4,230,135

[45] Oct. 28, 1980

[54] SORTED COIN COUNTING APPARATUS

[75] Inventor: Nobuo Ueda, Tokyo, Japan

[73] Assignee: Laurel Bank Machine Co., Ltd., Tokyo, Japan

[21] Appl. No.: 665

[22] Filed: Jan. 3, 1979

[51] Int. Cl.[3] ..... G07D 3/02

[52] U.S. Cl. ..... 133/3 D; 133/3 F; 133/8 E

[58] Field of Search ..... 133/3 R, 3 D, 3 F, 3 H, 133/8 R, 8 E

[56] References Cited

U.S. PATENT DOCUMENTS

| | | | |
|---|---|---|---|
| 975,458 | 11/1910 | Rees | 133/3 D |
| 1,068,785 | 7/1913 | Kohler | 133/3 D |
| 4,041,280 | 8/1977 | Ohsako et al. | 133/8 R X |

FOREIGN PATENT DOCUMENTS

| | | | |
|---|---|---|---|
| 2637446 | 3/1977 | Fed. Rep. of Germany | 133/3 F |
| 45-34084 | 11/1970 | Japan . | |

*Primary Examiner*—F. J. Bartuska

*Attorney, Agent, or Firm*—Fleit & Jacobson

[57] ABSTRACT

A sorted coin counting apparatus for counting the number of various kinds of such mixed coins are made to fall into the various selecting holes, which are formed in the bottom of a coin selecting track, separately in accordance with the kinds thereof, while being unidirectionally conveyed on the selecting track, so that they may be sorted. The sorted coin counting apparatus includes a stacking cylinder for stacking therein each kind of the coins which have fallen into the corresponding selecting hole. Further inclusive is a counting conveyor belt mechanism which is operative to discharge the coins from the stacking cylinder to a counting passage and to convey the coins discharged to a collecting cylinder and further to a storage box through the counting passage. A counting gear is shaped and positioned to be stepwise turned by the coins which are being conveyed on the counting passage. A counter is made responsive to the stepwise rotations of the counting gear so that the number of the coins counted may be indicated.

3 Claims, 5 Drawings Figures

SORTED COIN COUNTING APPARATUS

BACKGROUND OF THE INVENTION

1. Field of the Invention

The present invention relates to a coin counting apparatus, and more particularly to a sorted coin counting apparatus for counting the number of various kinds of mixed coins made to fall into various selecting holes formed in the bottom of a flat coin selecting track, selectively in accordance with the kinds thereof, while being unidirectionally conveyed on the selecting track.

2. Description of the Prior Art

There have been proposed and developed a variety of such coin counting apparatus including that disclosed in Japanese Patent Publication 34084/1970. In this coin counting apparatus, the number of coins falling into each of various selecting holes is converted into electric pulses which are fed, respectively for the coins falling through each selecting hole as input pulses to the respective storage circuits of an operation circuit. Thus, the pulses for operating the indicating circuit of a counter are fed to the count memory circuit in which the pulses of the upstream selecting section are stored until they become coincident with those stored in the respective count storage circuits, so that the number of the coins sorted in each of the selecting sections may be counted from the difference between the number of the coins introduced into the selecting section under consideration and the number of the coins passing through the same selecting section. In the coin counting apparatus, moreover, there is provided a phototube or a photoelectric element in the selecting track of the counting apparatus. This construction results in the disadvantage that a dead space is established below each of the selecting holes and that the overall length of the selecting track inevitably becomes large because the counting mechanism has to be built in the selecting track. Moreover, another counting mechanism is required for counting the difference between the number of the coins to falling into each of the selecting holes and the number of the coins passing over the same.

SUMMARY OF THE INVENTION

It is therefore an object of the present invention to provide a sorted coin counting apparatus which is free from the drawbacks of the prior art.

Another object of the present invention is to provide a compact sorted coin counting apparatus of the above type.

A further object of the present invention is to provide a sorted coin counting apparatus of the above type which is made operative to directly count only the coins selectively falling into their corresponding selecting holes, thus ensuring error-free counting operation.

According to a major feature of the present invention, there is provided a sorted coin counting apparatus for counting the number of any of various kinds of mixed coins made to fall into various selecting holes formed in the bottom of a coin selecting track, selectively in accordance with the kinds thereof, while being unidirectionally conveyed on said selecting track comprising: a stacking cylinder for stacking therein the kind of coins which have fallen into the associated selecting hole; a counting passage leading from said stacking cylinder; a counting conveyor belt mechanism for feeding the coins stacked in said stacking cylinder, to said counting passage and for conveying the same on said counting passage; a counting gear shaped and positioned to be intermittently turned by the coins conveyed on said counting passage; and counting means made responsive to the rotation of said counting gear for indicating the number of coins.

BRIEF DESCRIPTION OF THE DRAWINGS

Other objects and advantages of the present invention will become apparent from the following description made in conjunction with the accompanying drawings, in which.

DESCRIPTION OF THE PREFERRED EMBODIMENT

Figure 1:
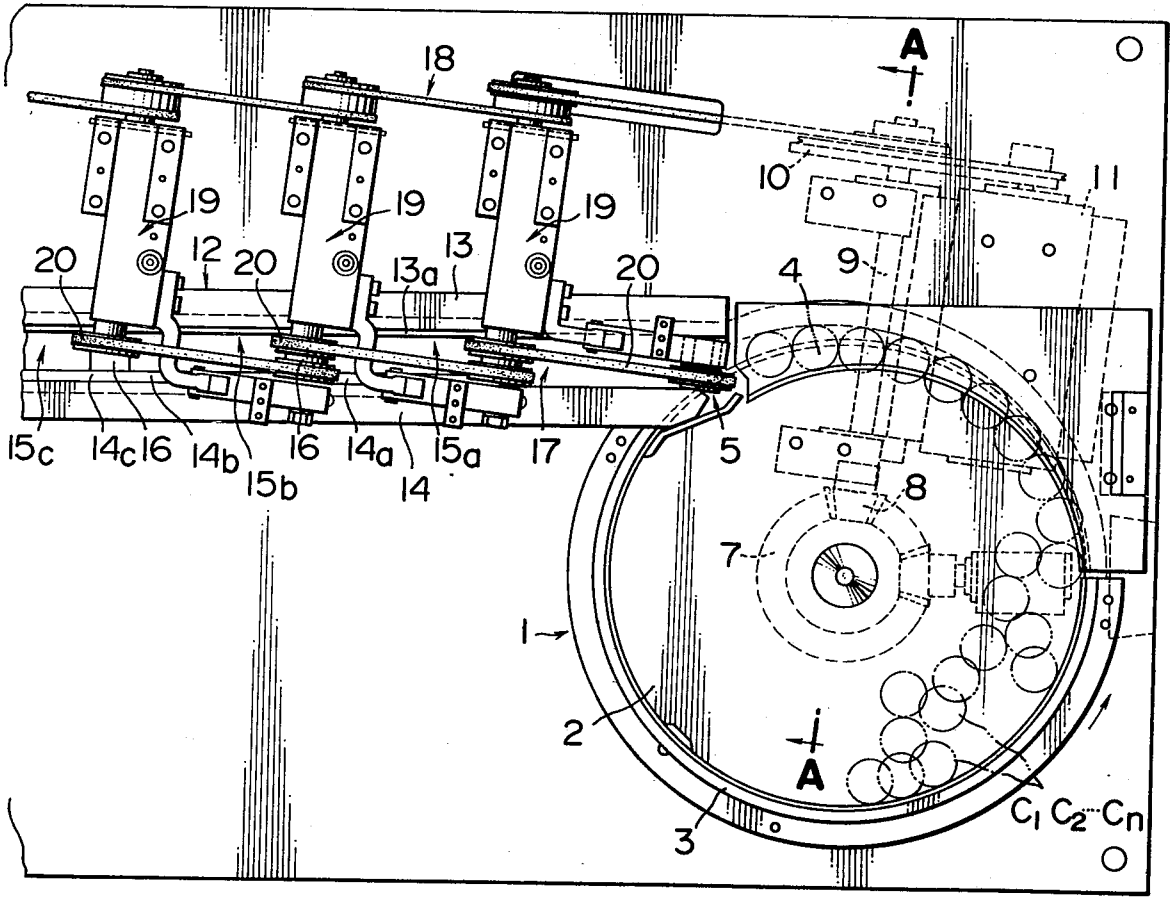
FIG. 1 is a partially cut-away top plan view showing a coin selecting apparatus with which an embodiment of the sorted coin counting apparatus of the present invention can be used.
Figure 2:
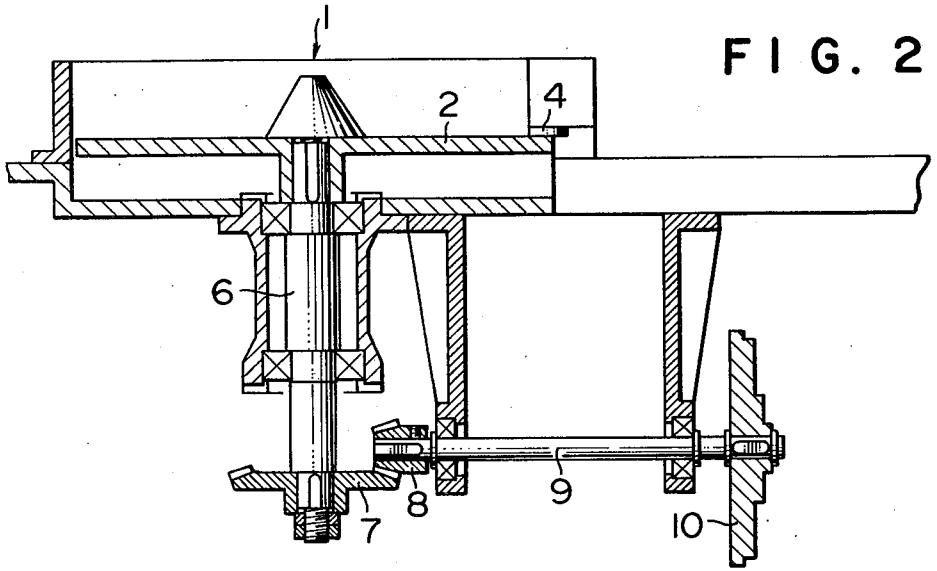
FIG. 2 is an enlarged section taken along the line A—A of FIG. 1.

One embodiment of the present invention will now be described with reference to the accompanying drawings. Referring to FIG. 1, a variety of mixed coins $C_1$, $C_2$, - - - , $C_n$ fed to the rotary disc 2 of a turning disc mechanism 1 are advanced by the centrifugal force of the disc 2 along a selecting ring 3 to a coin aligning course 4 where the coins $C_1$, $C_2$, - - - , $C_n$ are arranged into a row so that they may be continuously fed to an outlet 5. The rotary disc 2 is turned by a power train in which a large gear 7 mounted to the spindle 6 of the disc 2 is in meshing engagement with a smaller gear 8, the spindle 9 of this smaller gear 8 being mounted at its one end to a drive pulley 10 and this drive pulley 10 being driven by an electric motor 11. The outlet 5 of the turning disc mechanism 1 is constructed to lead to the coin inlet side of a selecting track 12. This selecting track 12 is composed of a reference rail 13 and a selecting rail 14 with a variety of selecting holes 15*a*, 15*b*, - - - , 15*n* having different widths formed between the two rails 13 and 14. The reference rail 13 is formed with a guide edge 13*a* having a preset width, whereas the selecting rail 14 is formed with selecting edges 14, 14*b*, - - - 14*n* having different widths or extensions so that the coins $C_1$, $C_2$, - - - $C_n$ may be advanced while riding on the guide edge 13*a* and the selecting edges 14*a*, 14*b*, - - - , 14*n*. The selecting holes 15*a*, 15*b*, - - - , 15*n* are made to have their widths increase by increments with increasing distance from the turning disc mechanism 1 and are defined by a sorted number of transfer plates 16. Moreover, there is also provided a track bottom plate which extends at the bottom of the selecting track 12 from the outlet 5 of the turning disc mechanism 1 to the most upstream selecting hole 15*a*. The widths of the selecting holes 15*a*, 15*b*, - - - , 15*n* are made slightly larger than the diameters of the coins $C_1$, $C_2$, - - - $C_n$ to be selected respectively thereby. There is arranged under tension above the selecting track 12 a selecting belt mechanism 18 which is operative to make the mixed coins $C_1$, $C_2$, - - - , $C_n$ fall into the various selecting holes 15*a*, 15*b*, - - - , 15*n* in accordance with their kinds while conveying the coins $C_1$, $C_2$, - - - , $C_n$ in one direction. The selecting belt mechanism 18 thus arranged is composed of a corresponding number of belt carrying mechanisms 19 which have their belts 20 carried under tension at such an inclination that they progressively approach the reference rail 13 as they run above the track bottom plate 17 and the various selecting holes 15*a*, 15*b*, - - - , 15*n*. As to the arrangement of the belts 20, moreover, each pair of adjacent belts 20 are partially overlapped. The belts 20 thus arranged are carried by the rotational force of the drive pulley 10, which force is also used to turn the rotary disc 2, so that they can run at different speeds.

Figure 5:
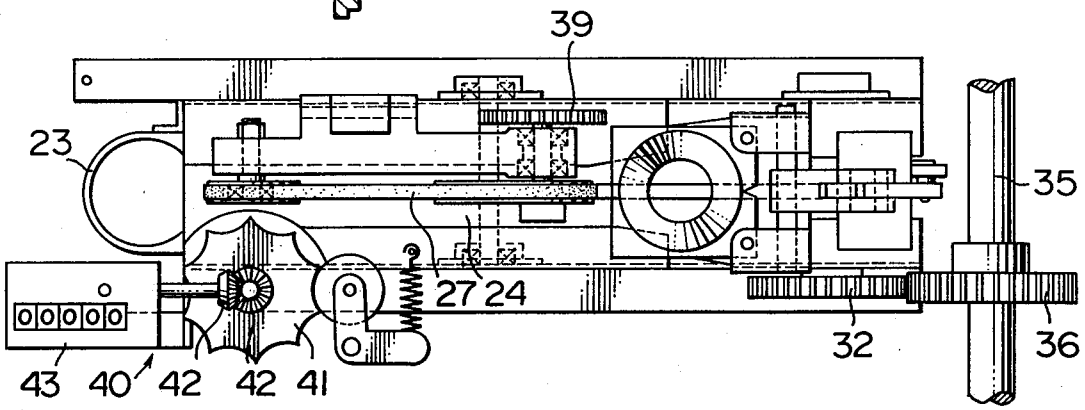
FIG. 5 is a top plan view showing the sorted coin counting apparatus of FIGS. 3 and 4.
Figure 3:
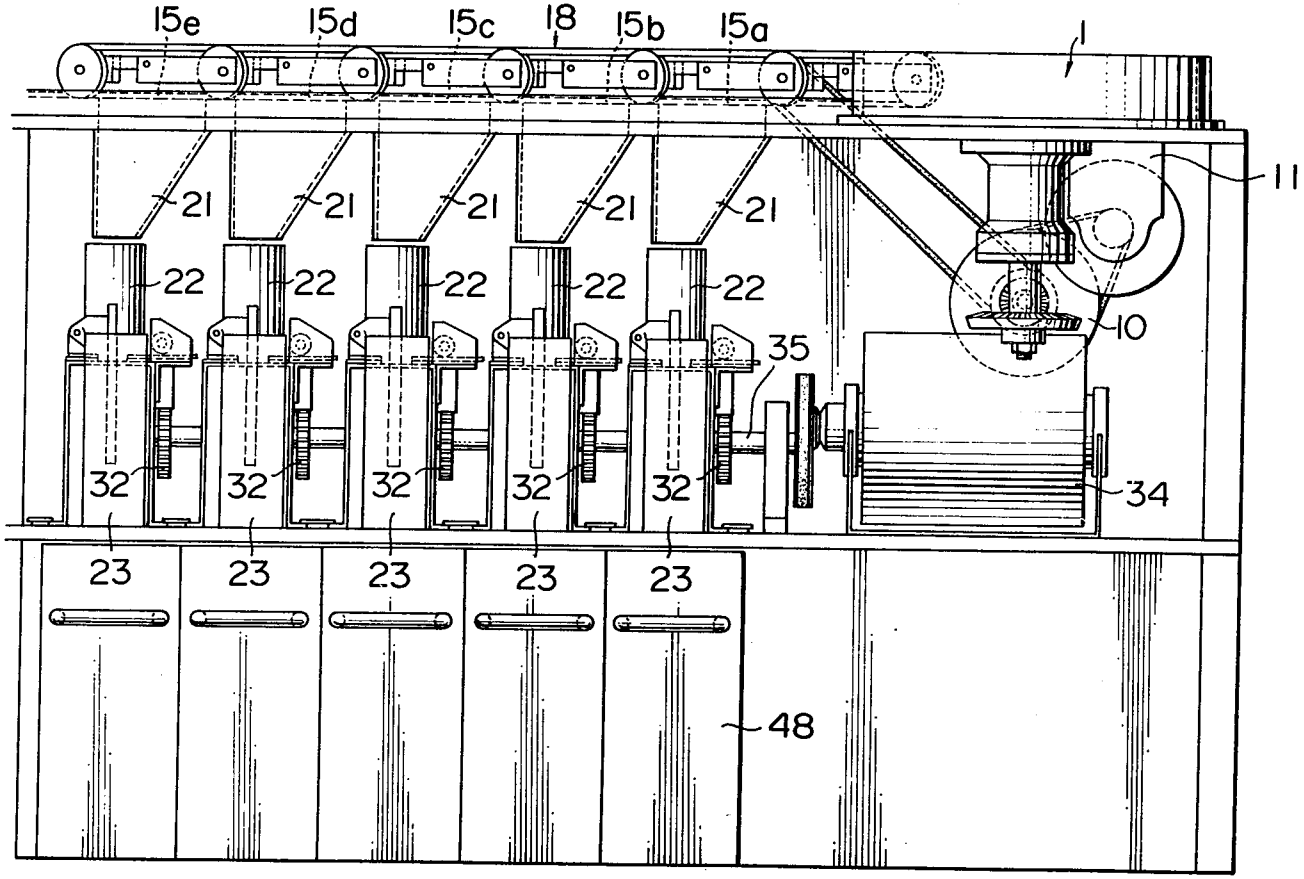
FIG. 3 is a side elevation showing the sorted coin counting apparatus according to the present invention.
Figure 4:
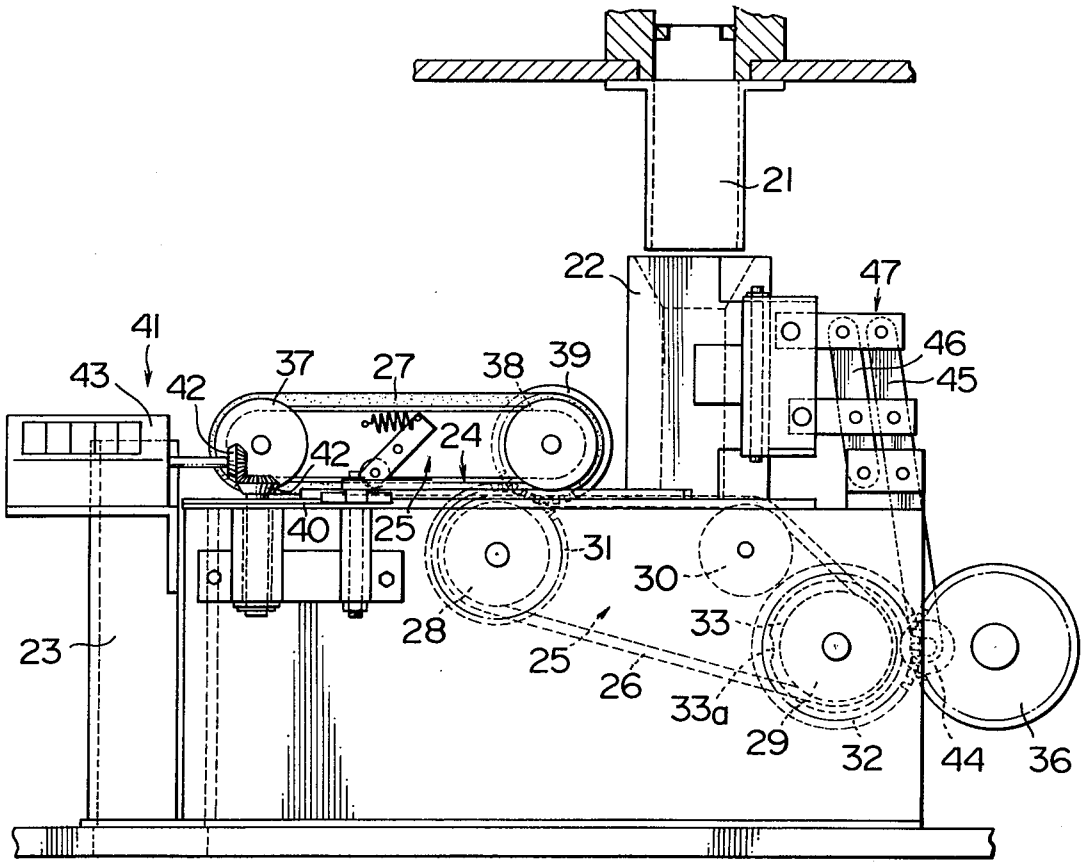
FIG. 4 is a front elevation of the essential portions of the sorted coin counting apparatus of FIG. 3.

Turning now to FIGS. 3 to 5, a description will be given of the sorted coin counting apparatus according to the present invention for counting the number of the sorted coins $C_1$, $C_2$, - - - , $C_n$ which have been made to fall into the selecting holes 15*a*, 15*b*, - - - , 15*n* in accordance with their kinds while being carried unidirectionally on the selecting track 12 by the actions of the selecting belt mechanism 18. There are connected to the selecting holes 15*a*, 15*b*, - - - , 15*n* a corresponding number of guide chutes 21 which in turn are connected to a corresponding number of stacking cylinders 22. There are also provided a corresponding number of counting passages 24 which are arranged to horizontally extend from the lower ends of the stacking cylinders 22 to a corresponding number of collecting cylinders 23. Each of the counting passages 24 thus arranged is equipped with a counting conveyor belt mechanism 25 which is made operative to convey the corresponding kind of the coins $C_1$, $C_2$, - - - , $C_n$ stacked in the corresponding stacking cylinder 22 to the corresponding collecting cylinder 23 along the corresponding counting passage 24. All of these counting conveyor belt mechanisms 25 have the same construction and therefore only one of them is explained in the following. Namely, the most upstream counting conveyor belt mechanism 25 is equipped with a discharge belt 26 for discharging the smallest coins $C_1$ in the most upstream stacking cylinder 22 to the most upstream counting passage 24 and with a conveyor belt 27 for conveying the coins $C_1$ from the particular counting passage 24 to the most upstream collecting cylinder 23. The discharge belt 26 is made to run on pulleys 28, 29 and 30 which are arranged below the counting passage 24. A drive gear 31 and its driven gear 32 are mounted on the shafts of the pulleys 28 and 29, respectively. A cam plate 33 is also mounted to the shaft of the latter pulley 29. The running operation of the discharge belt 26 is effected such that the rotational motion of a motor 34 is transmitted to a gear shaft 35 and such that a primary gear 36 mounted on the gear shaft 35 is in meshing engagement with the driven gear 32 mounted on the shaft of the pulley 29. On the other hand, the afore-mentioned conveyor belt 27 is made to run on pulleys 37 and 38 which are arranged above the counting passage 24. There is mounted on the shaft of the latter pulley 38 a gear 39 which is in meshing engagement with the drive gear 31 mounted on the shaft of the pulley 28. Moreover, there is provided a counting gear 40 which is located to have a portion thereof protruding to a position above the most upsteam counting passage 24 so that it may be turned by increments by the smallest coins $C_1$ conveyed by the conveyor belt 27. There is also provided a counting mechanism 41 which is made responsive to the rotation of the corresponding counting gear 40 so as to count the number of the coins $C_1$ passing through the corresponding counting passage 24. The counting mechanism 41 is equipped with a counter 43 which is operative to indicate the number of coins when the rotation of the counting gear 40 is transmitted thereto through bevel gears 42 which are engaged with each other.

As best shown in FIG. 4, a roller 44 is held in contact with the cam plate 33 which is mounted on the shaft of the pulley 29. A larger lever 45 is hinged at its one end to the roller 44 so that it may constitute a link mechanism 47 together with a smaller lever 46. The link mechanism 47 thus constituted is attached to the stacking cylinder 22. Since the cam plate 33 is formed on its periphery with recesses 33*a* (two in FIG. 4) and which are arranged at a preset spacing, the vibrations generated by the contact between the cam plate 33 and the roller 44 are transmitted to the larger lever 45. As a result, the stacking cylinder 22 is vibrated by the link mechanism 47 so that the falling coins $C_1$ can be stacked horizontally one on another.

It should be noted here that the running speed of the discharge belt 26 has to be preset so that the number of coins $C_1$ to be discharged from the stacking cylinder 22 by the action of the discharge belt 26 is slightly larger than that of the coins $C_1$ to be left in the stacking cylinder 22 after they have fallen down in a consecutive manner.

It should also be noted that the counting mechanism 41 may optionally include a photoelectric tube mounted on the counting gear 40 (though none is shown) so that the number of revolutions of the gear 40 may be converted into electric pulses and indicated by means of an electromagnetic counter (not shown either).

The operations of the so constructed sorted coin counting apparatus will be described hereinafter. A variety of mixed coins $C_1$, $C_2$, - - - , $C_n$ are supplied onto the rotating disc 2 of the turning disc mechanism 1 and then discharged in a row to the outlet 5 by the centrifugal force of the disc 2. The coins $C_1$, $C_2$, - - - $C_n$ are then guided from the outlet 5 onto the selecting track 12 by the action of the selecting belt mechanism 18 so that they may fall into the various selecting holes 15*a*, 15*b*, - - - , 15*n* in accordance with their kinds while being conveyed unidirectionally on the selecting track 12. Among the coins $C_1$, $C_2$, - - - , $C_n$ having fallen into the corresponding selecting holes 15*a*, 15*b*, - - - , 15*n*, the smallest coins $C_1$ having fallen into the first or most upstream selecting hole 15*a* are guided by their guide chute 21 so that they can further fall into their stacking cylinder 22. The operation of the apparatus will be described with respect to these smallest coins on the understanding that the same operations also apply to the other coins of differing size. The coins $C_1$ falling down into the stacking cylinder 22 can be stacked horizontally one on another because the cylinder 22 itself is horizontally vibrated by means of the link mechanism 47. The coins $C_1$ thus stacked in the cylinder 22 are then discharged onto the counting passage 24 by the action of the discharge belt 26. The coins $C_1$ thus discharged onto the counting passage 24 are then conveyed into the collecting cylinder 23 by the action of the conveyor belt 27. The coins $C_1$ being conveyed on the counting passage 24 turn the counting gear 40 by increments. When the counting gear 40 is turned in this way, the resultant rotations are transmitted through the coacting bevel gears 42 to the counter 43 so that the number of coins $C_1$ can be indicated in the counter 43. Thereafter, the coins $C_1$ falling into the collecting cylinder 23 are stored in a storage box 48, as shown in FIG. 3. The remaining coins $C_2$, $C_3$, - - - , $C_n$ are likewise counted and stored in their storage boxes 48.

Alternatively, moreover, the counting passage 24 may be formed with a hole narrower than the diameter of the corresponding coins $C_1$, $C_2$, - - - , or $C_n$ which are to pass through the particular counting passage 24. With this alternative construction, even if the coin or coins $C_1$ to fall into an upstream selecting hole, e.g., 15 do not fall down into the proper selecting hole 15*a* but fall into the next downstream hole 15*b* together with the next larger coins $C_2$, then the erroneous coin or coins $C_1$ will fall down into the hole in the counting passage 24 so that there is no fear of their being erroneously counted as the larger coins $C_2$.

As has been described hereinbefore, according to the present invention, there is no necessity for providing any counting mechanism in a selecting track which is formed with a variety of selecting holes in its bottom. Moreover, the space below the selecting track can be effectively used while improving the total balance of the selected coin counting apparatus. Since, still moreover, the coins having fallen down into the respective selecting holes for selecting purposes are counted independently and directly in accordance with their kinds, the conventional counting mechanism for counting the difference between the number of the coins having fallen down and the number of the coins passing can be dispensed with while ensuring the desired correct counting operation.

What is claimed is:

1. A sorted coin counting apparatus for counting the number of various kinds of such mixed coins falling into various selecting holes formed in the bottom of a coin selecting track, selectively in accordance with the kinds thereof, while being unidirectionally conveyed on said selecting track, comprising: a stacking cylinder for stacking therein the kind of coins which have fallen into the corresponding selecting hole; a counting passage leading from said stacking cylinder; a counting conveyor belt mechanism for feeding the coins stacked in said stacking cylinder to said counting passage and for conveying the same on said counting passage; a counting gear shaped and positioned to be turned by increments by the coins conveyed on said counting passage; and counting means made responsive to the rotation of said counting gear for indicating the number of coins, further comprising vibrating means for vibrating said stacking cylinder in a horizontal direction so that the coins may be stacked one on another in said stacking cylinder.

2. A sorted coin counting apparatus according to claim 1, wherein said vibrating means is a link mechanism attached to said stacking cylinder.

3. A sorted coin counting apparatus for counting the number of various kinds of such mixed coins falling into various selecting holes formed in the bottom of a coin selecting track, selectively in accordance with the kinds thereof, while being unidirectionally conveyed on said selecting track, comprising: a stacking cylinder for stacking therein the kinds of coins which have fallen into the corresponding selecting hole; a counting passage leading from said stacking cylinder; a counting conveyor belt mechanism for feeding the coins stacked in said stacking cylinder to said counting passage and for conveying the same on said counting passage; a counting gear shaped and positioned to be turned by increments by the coins conveyed on said counting passage; and counting means made responsive to the rotation of said counting gear for indicating the number of coins, wherein said counting conveyor belt mechanism carries a discharge belt having a feeding speed higher than the falling speed of the mixed coins, wherein said counting conveyor belt mechanism further carries a conveyor belt made receptive to the mixed coins from said discharge conveyor for conveying the same to said counting gear along said counting passage.

* * * * *